US009234438B2

(12) United States Patent
Lee

(10) Patent No.: US 9,234,438 B2
(45) Date of Patent: Jan. 12, 2016

(54) TURBINE ENGINE COMPONENT WALL HAVING BRANCHED COOLING PASSAGES

(75) Inventor: Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 1035 days.

(21) Appl. No.: 13/463,892

(22) Filed: May 4, 2012

(65) Prior Publication Data

US 2013/0294898 A1 Nov. 7, 2013

(51) Int. Cl.
*F01D 25/12* (2006.01)
*F01D 5/18* (2006.01)

(52) U.S. Cl.
CPC ..... *F01D 25/12* (2013.01); *F01D 5/186* (2013.01); *F05D 2260/202* (2013.01); *F05D 2260/204* (2013.01)

(58) Field of Classification Search
CPC ..... F01D 5/08; F01D 5/182; F01D 5/183; F01D 5/184; F01D 5/186; F01D 5/187; F01D 25/12; F05D 2240/81; F05D 2260/20; F05D 2260/202; F05D 2260/203; F05D 2260/204
USPC ..... 415/115, 116; 416/97 R, 97 A, 231 R
See application file for complete search history.

(56) References Cited

U.S. PATENT DOCUMENTS 4,197,443 A 4/1980 Sidenstick
4,487,550 A * 12/1984 Horvath ..... F01D 5/20 416/92
4,669,957 A * 6/1987 Phillips et al. ..... 416/97 R
4,923,371 A * 5/1990 Ben-Amoz ..... 416/97 R
5,062,768 A * 11/1991 Marriage ..... 416/97 R
5,326,224 A * 7/1994 Lee et al. ..... 416/97 R
5,651,662 A 7/1997 Lee et al.
5,660,525 A 8/1997 Lee et al.
5,683,600 A 11/1997 Kelley et al.
6,307,175 B1 10/2001 Blochlinger et al.
6,383,602 B1 5/2002 Fric et al.
6,402,470 B1 * 6/2002 Kvasnak ..... F01D 5/187 415/115
6,916,150 B2 * 7/2005 Liang ..... F01D 5/20 415/115
7,273,351 B2 * 9/2007 Kopmels ..... 416/97 R
7,328,580 B2 2/2008 Lee et al.
7,334,991 B2 * 2/2008 Liang ..... F01D 5/081 416/97 R
7,351,036 B2 4/2008 Liang
7,537,431 B1 * 5/2009 Liang ..... F01D 5/187 415/115
7,549,844 B2 6/2009 Liang
7,553,534 B2 6/2009 Bunker
7,632,062 B2 * 12/2009 Harvey ..... F01D 5/20 415/115
7,665,956 B2 * 2/2010 Mitchell et al. ..... 415/115
7,704,039 B1 * 4/2010 Liang ..... 415/116

(Continued)

*Primary Examiner* — Craig Kim
*Assistant Examiner* — Wayne A Lambert

(57) ABSTRACT

A component wall in a turbine engine includes a substrate and at least one cooling passage that extends through the substrate for delivering cooling fluid from a chamber associated with an inner surface of the substrate to an outer surface of the substrate. Each cooling passage is divided into at least two branches that receive cooling fluid from an entrance portion of the cooling passage that is in communication with the chamber. The branches each include an intermediate portion that extends transversely from the entrance portion and that receives cooling fluid from the entrance portion, and an exit portion that extends transversely from the respective intermediate portion. The exit portions receive the cooling fluid from the intermediate portions and deliver the cooling fluid out of the respective branch through exit portion outlets.

17 Claims, 5 Drawing Sheets

(56) References Cited

U.S. PATENT DOCUMENTS

| | | | | |
|---|---|---|---|---|
| 8,052,378 | B2 | 11/2011 | Draper | |
| 8,057,182 | B2 | 11/2011 | Brittingham et al. | |
| 8,371,814 | B2 * | 2/2013 | Ramachandran et al. | 416/90 R |
| 2002/0018717 | A1 * | 2/2002 | Dailey | 416/97 R |
| 2005/0281675 | A1 * | 12/2005 | Liang | 416/97 R |
| 2006/0078417 | A1 * | 4/2006 | Benton | 415/115 |
| 2008/0057271 | A1 | 3/2008 | Bunker | |
| 2010/0129231 | A1 * | 5/2010 | Brittingham et al. | 416/97 R |
| 2011/0236178 | A1 * | 9/2011 | Devore et al. | 415/1 |

* cited by examiner

TURBINE ENGINE COMPONENT WALL HAVING BRANCHED COOLING PASSAGES

FIELD OF THE INVENTION

The present invention relates to turbine engines, and, more particularly, to cooling passages provided in a wall of a component, such as in the sidewall of an airfoil in a gas turbine engine.

BACKGROUND OF THE INVENTION

In a turbomachine, such as a gas turbine engine, air is pressurized in a compressor then mixed with fuel and burned in a combustor to generate hot combustion gases. The hot combustion gases are expanded within a turbine of the engine where energy is extracted to power the compressor and to provide output power used to produce electricity. The hot combustion gases travel through a series of stages with passing through the turbine. A stage may include a row of stationary airfoils, i.e., vanes, followed by a row of rotating airfoils, i.e., blades, where the blades extract energy from the hot combustion gases for powering the compressor and providing output power.

Since the airfoils, i.e., vanes and blades, are directly exposed to the hot combustion gases as the gases pass through the turbine, these airfoils are typically provided with internal cooling circuits that channel a cooling fluid, such as compressor discharge air, through the airfoil and through various film cooling holes around the surface thereof. For example, film cooling holes are typically provided in the walls of the airfoils for channeling the cooling air through the walls for discharging the air to the outside of the airfoil to form a layer of film cooling air, which protects the airfoil from the hot combustion gases.

Film cooling effectiveness is related to the concentration of the film cooling air at the surface being cooled. In general, the greater the cooling effectiveness, the more efficiently the surface can be cooled. A decrease in cooling effectiveness causes greater amounts of cooling air to be necessary to maintain a certain cooling capacity, which may cause a decrease in engine efficiency.

SUMMARY OF THE INVENTION

In accordance with a first aspect of the present invention, a component wall in a turbine engine is provided. The component wall comprises a substrate and at least one cooling passage that extends through the substrate. The substrate has a thickness defined between a first surface and a second surface opposed from the first surface. The at least one cooling passage delivers cooling fluid from a chamber associated with the first surface to the second surface. The at least one cooling passage is divided at a first location downstream from an inlet of the at least one cooling, passage located at the first surface of the substrate. The at least one cooling passage comprises an entrance portion extending from the inlet to the first location for receiving the cooling fluid from the chamber, and first and second branches that receive the cooling fluid from the entrance portion at the first location. The first and second branches each comprise an intermediate portion that extends transversely from the entrance portion and receives cooling fluid from the entrance portion, and an exit portion that extends transversely from the respective intermediate portion. The exit portion receives the cooling fluid from the respective intermediate portion and delivers the cooling fluid out of the respective branch through an outlet of the respective exit portion. The cooling fluid is delivered out of the at least one cooling passage to provide cooling to the second surface of the substrate.

In accordance with a second aspect of the present invention, a component wall in a turbine engine is provided. The component wall comprises a substrate and at least one cooling passage that extends through the substrate. The substrate has a thickness defined between a first surface and a second surface opposed from the first surface. The at least one cooling passage delivers cooling fluid from a chamber associated with the first surface to the second surface and comprises an entrance portion, a first intermediate portion, and a first exit portion. The entrance portion extends from an inlet of the at least one cooling passage to a first location spaced from the inlet in a first direction that is perpendicular to the second surface of the substrate. The first intermediate portion extends transversely from the entrance portion from the first location to a second location spaced from the first location in a second direction that is parallel to the second surface of the substrate. The first exit portion extends transversely from the first intermediate portion from the second location to a first outlet spaced from the second location in the first direction.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
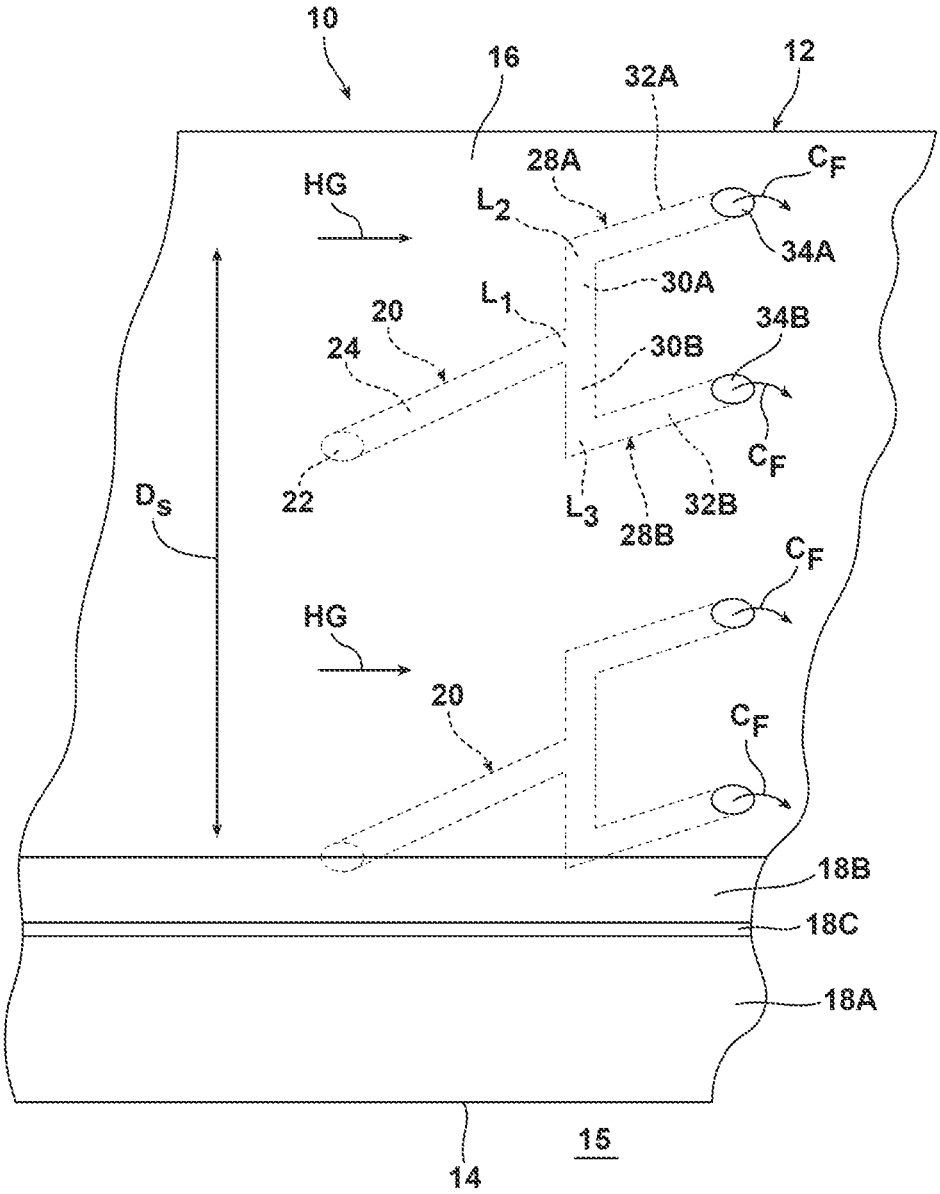
FIG. 1 is a perspective view of a portion of a film cooled component wall according to an embodiment of the invention.
Figure 2:
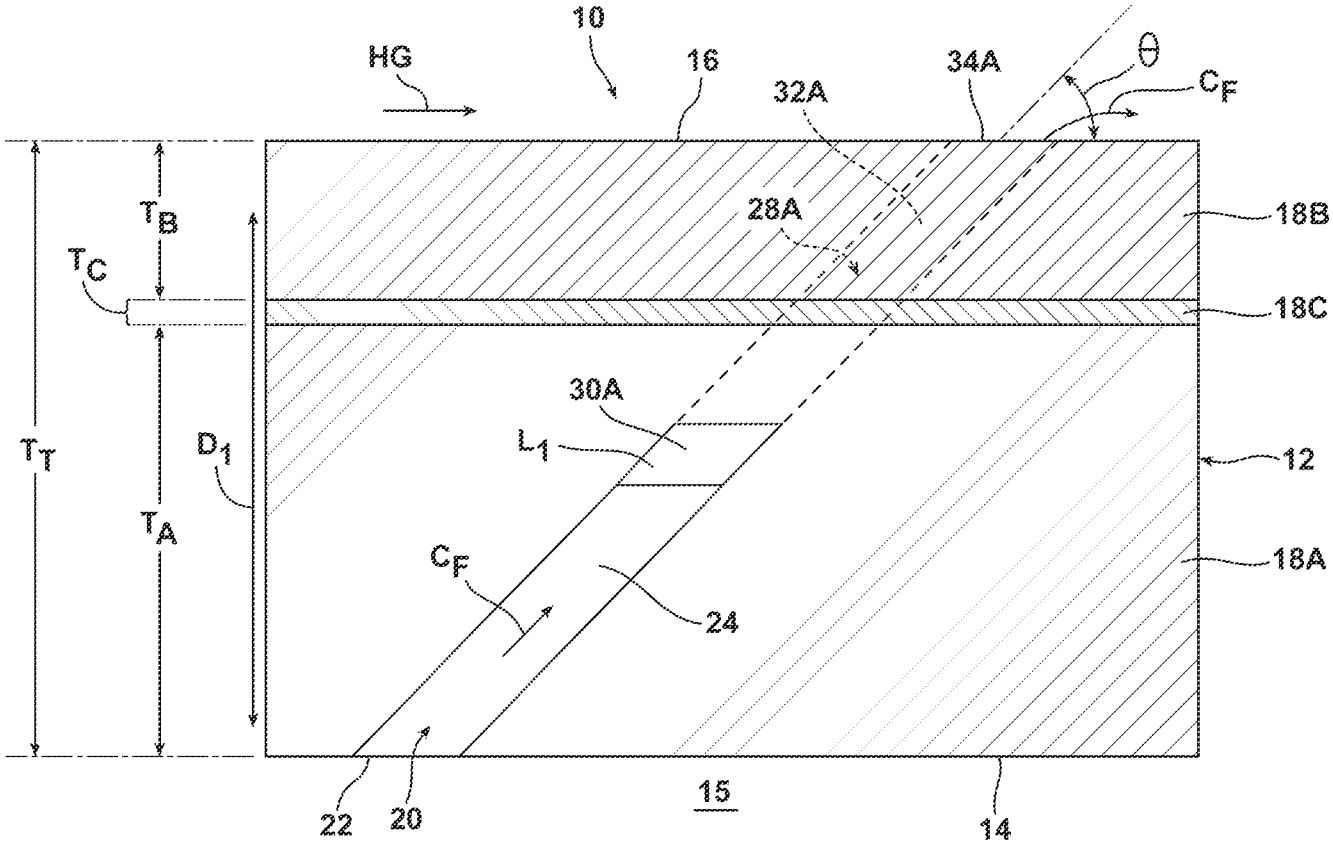
FIG. 2 is a side cross sectional view of the film cooled component wall shown in FIG. 1.
Figure 3:
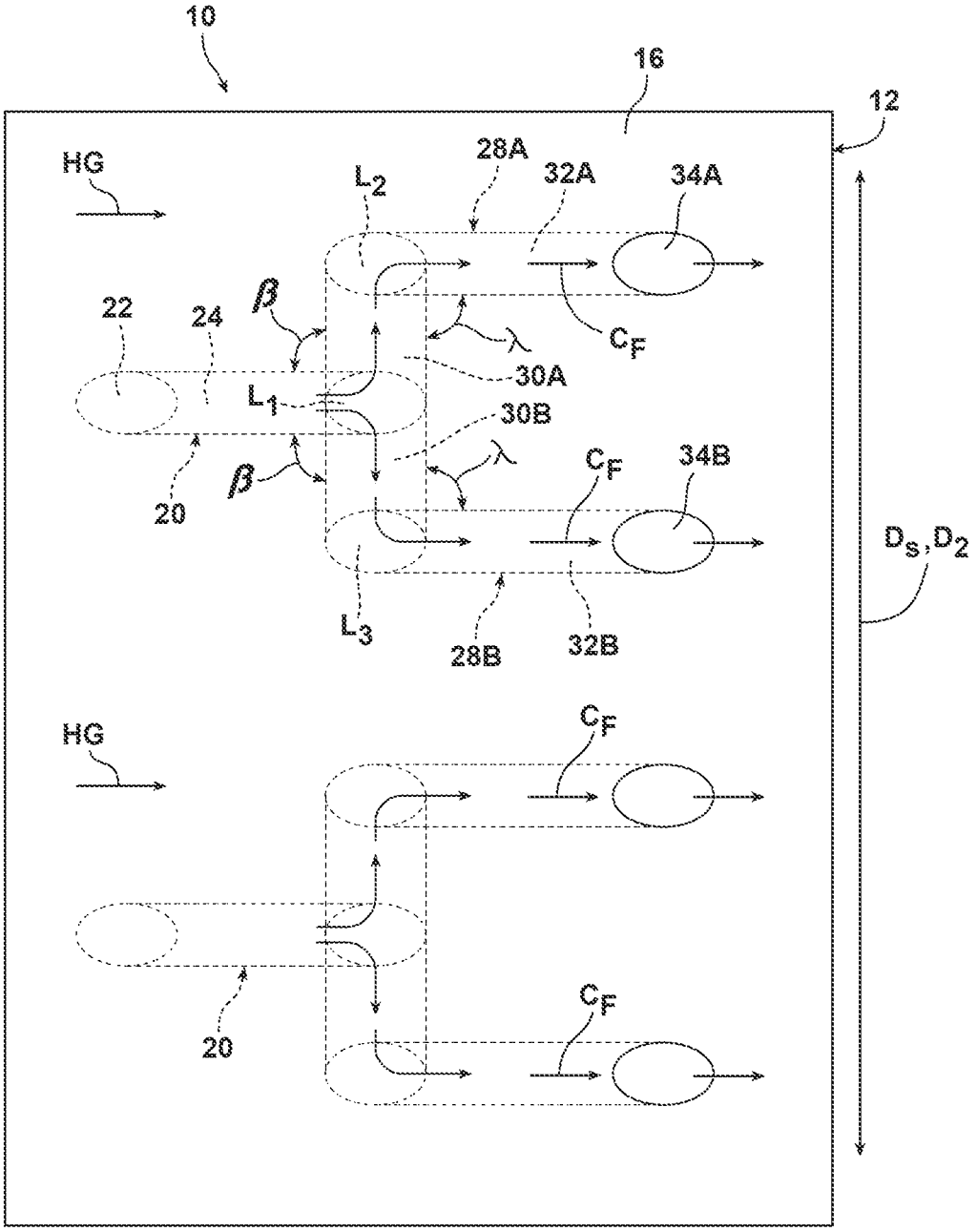
FIG. 3 is a plan cross sectional view of the film cooled component wall shown in FIG. 1.

Referring to FIGS. 1-3, a film cooled component wall 10 according to an embodiment of the invention is shown. The component wall 10 may comprise a wall of a component in turbine engine, such as an airfoil, i.e., a rotating turbine blade or a stationary turbine vane, a combustion liner, an exhaust nozzle, and the like.

The component wall 10 comprises a substrate 12 having a first surface 14 and a second surface 16, see FIGS. 1 and 2. The first surface 14 may be referred to as the "cool" surface, as the first surface 14 defines a chamber 15 containing cooling fluid, while the second surface 16 may be referred to as the "hot" surface, as the second surface 16 may be exposed to hot combustion gases $H_G$ during operation. Such combustion gases $H_G$ may have temperatures of up to about 2,000° C. during operation of the engine. In the embodiment shown, the first surface 14 and the second surface 16 are opposed and substantially parallel to each other.

The material forming the substrate 12 may vary depending on the application of the component wall 10. For example, the substrate 12 preferably comprises a material capable of withstanding typical operating conditions that occur within the respective portion of the engine, such as, for example, ceramics and metal-based materials, e.g., a steel, nickel, cobalt, or iron based superalloy, etc.

Referring to FIGS. 1 and 2, the substrate 12 may comprise one or more layers, and in the embodiment shown comprises an inner layer 18A, an outer layer 18B, and an intermediate layer 18C between the inner and outer layers 18A, 18B. The inner layer 18A in the embodiment shown comprises, for example, a steel, nickel, cobalt, or iron based superalloy, and, in one embodiment, may have a thickness $T_A$ of about 1.2 mm to about 2.0 mm, see FIG. 2. The outer layer 18B in the embodiment shown comprises a thermal barrier coating that is used to provide a high heat resistance for the component wall 10, and, in one embodiment, may have a thickness $T_B$ of about 0.5 mm to about 1.0 mm. The intermediate layer 18C in the embodiment shown comprises a bond coat that is used to bond the outer layer 18B to the inner layer 18A, and, in one embodiment, may have a thickness $T_C$ of about 0.1 mm to about 0.2 mm. The inner, outer, and intermediate layers 18A-C thus define a total thickness $T_T$ of the substrate 12 between the first and second surfaces 14, 16, which total thickness $T_T$ in the embodiment shown may be about 1.8 mm to about 3.2 mm.

While the substrate 12 in the embodiment shown comprises the inner, outer, and intermediate layers 18A-C, it is understood that substrates having additional or fewer layers could be used without departing from the spirit and scope of the invention. For example, the thermal barrier coating, i.e., the outer layer 18B, may comprise a single layer or may comprise more than one layer. In a multi-layer thermal barrier coating application, each layer may comprise a similar or a different composition and may comprise a similar or a different thickness.

As shown in FIGS. 1-3, the component wall 10 includes at least one, and, as shown in FIGS. 1 and 3, a series of cooling passages 20 that extend through the substrate 12 from the first surface 14 of the substrate 12 to the second surface 16 of the substrate 12, i.e., the cooling passages 20 extend through the first, second, and third layers 18A, 18B, 18C in the embodiment shown. The cooling passages 20 deliver cooling fluid $C_F$, such as, for example, compressor discharge air, from the chamber 15 defined by the first surface 14 to the second surface 16. In the embodiment shown, the cooling passages 20 are inclined, i.e., the cooling passages 20 extend through the substrate 12 at an angle θ, see FIG. 2. The angle θ may be, for example, about 15 degrees to about 60 degrees relative to the second surface 16 of the substrate 12, and in a preferred embodiment is in a range of from about 30 degrees to about 45 degrees relative to the second surface 16. As shown in FIGS. 1 and 3, the cooling passages 20 are spaced apart from each other across a dimension $D_S$ of the substrate 12.

A single one of the cooling passages 20 will now be described, it being understood that the remaining cooling passages 20 of the component wall 10 may be substantially identical to the described cooling passage 20.

The cooling passage 20 includes an inlet 22 located at the first surface 14 of the substrate 12. The inlet 22 may have a circular or ovular shape, as most clearly shown in FIGS. 1 and 3, or any other suitable shape. An entrance portion 24 of the cooling passage 20 receives cooling fluid $C_F$ from the chamber 15 via the inlet 22. The entrance portion 24 extends from the inlet 22 to a first location $L_1$, which is spaced from the inlet 22 in a first direction $D_1$ (see FIG. 2) that is perpendicular to the second surface 16 of the substrate 12. As shown most clearly in FIG. 2, the first location $L_1$ in the embodiment shown is positioned downstream from the inlet 22 with regard to a flow direction of the cooling fluid $C_F$ passing through the cooling passage 20, and is positioned about midway between the first and second surfaces 14, 16 of the substrate 12. However, it is understood that the first location $L_1$ could be positioned closer to either of the first or second surfaces 14, 16 of the substrate 12 as desired.

Referring to FIGS. 1 and 3, the cooling passage 20 is divided at the first location $L_1$ into first and second branches 28A, 28B that each receive a portion of the cooling fluid $C_F$ from the entrance portion 24 at the first location $L_1$. The first and second branches 28A, 28B each comprise an intermediate portion 30A, 30B, which intermediate portions 30A, 30B are positioned on opposite sides of the entrance portion 24 from one another, and an exit portion 32A, 32B. The intermediate portion 30A, 30B of each branch 28A, 28B extends transversely from the entrance portion 24 at an angle β of from about 60 degrees to about 90 degrees relative to the entrance portion 24, see FIG. 3. In the embodiment shown the angle β is about 90 degrees. The intermediate portions 30A, 30B each receive a portion of the cooling fluid $C_F$ from the entrance portion 24. As shown in FIGS. 1 and 3, the first intermediate portion 30A extends from the first location $L_1$ to a second location $L_2$, and the second intermediate portion 30B extends from the first location $L_1$ to a third location $L_3$, wherein the second and third locations $L_2$, $L_3$ are spaced from the first location $L_1$ in a second direction $D_2$ that is parallel to the second surface 16 of the substrate 12, see FIG. 3.

The exit portion 32A, 32B of each branch 28A, 28B extends transversely from its respective intermediate portion 30A, 30B at an angle λ of from about 60 degrees to about 90 degrees relative to the respective intermediate portion 30A, 30B, see FIG. 3. In the embodiment shown the angle λ is about 90 degrees. The exit portions 32A, 32B receive the cooling fluid $C_F$ from their respective intermediate portions 30A, 30B and deliver the cooling fluid $C_F$ out of their respective branches 28A, 28B through first and second outlets 34A, 34B of the exit portions 32A, 32B, wherein the outlets 34A, 34B are spaced from the second and third locations $L_2$, $L_3$ in the first direction D. As shown in FIGS. 1 and 3, the first exit portion 32A extends from the second location $L_2$ to the first outlet 34A, and the second exit portion 32B extends from the third location $L_3$ to the second outlet 34B. In the embodiment shown in FIGS. 1-3, the cooling fluid $C_F$ is delivered out of the cooling passage 20 through the outlets 34A, 34B directly to the second surface 16 of the substrate 12 to provide film cooling to the second surface 16, such that the cooling passage 20 of this embodiment comprises a single inlet 22 and two outlets 34A, 34B.

As shown in FIGS. 1-3, the exit portions 32A, 32B of the first and second branches 28A, 28B may be generally parallel to the entrance portion 24 of the cooling passage 20. Further, the first and second branches 28A, 28B are completely enclosed within the substrate 12 between the entrance portion 24 and the outlets 34A, 34B of the first and second exit portions 32A, 32B.

It is noted that traditional drilling procedures are not capable of forming the first and, second branches 28A, 28B in the substrate 12 since the branches 28A, 28B are completely enclosed in the substrate 12 and due to the multiple direction turns of the cooling passage 20, i.e., the turn at the division of the cooling passage 20 at the first location $L_1$ into the first and second branches 28A, 28B and the turns of the first and second branches 28A, 28B at the second and third locations $L_2$, $L_3$. Further, these multiple direction turns of the cooling passage 20 are defined completely within enclosed portion of the substrate 12, i.e., within the first layer 18A of the substrate 12 in the embodiment shown, and not by two separate wall sections or layers that are joined together to form the portion of the cooling passage 20 having the direction turns therebetween. Since the cooling passage 20 including the portion having the multiple direction turns is defined completely within the enclosed portion of the substrate 12, the integrity of the substrate 12 is maintained and a complexity of the component wall 10 is improved over a configuration wherein the cooling passage is defined between two adjoined wall sections or layers. According to an embodiment of the invention, the cooling passage 20 may be cast into the substrate 12. For example, a sacrificial member (not shown), such as a ceramic core, may be formed into the shape of a cooling passage to be formed, and the substrate 12 may be molded or otherwise disposed over the core. Thereafter, the core can be removed, such as in a burn-off procedure or with an acidic solution, thereby leaving an empty space so as to create the cooling passage 20. If multiple cooling passages 20 are to be formed, multiple ceramic cores could be used, which cores may be joined together outside of the substrate 12 in an integral structure.

The diameter of the various portions of the cooling passages 20 may be uniform along their length or may vary. Further, the outlets 34A, 34B of the exit portions 32A, 32B of the branches 28A, 28B may comprise other shapes that the ovular shapes shown in FIGS. 1-3, such as, for example, diffuser shapes.

As shown in FIGS. 1 and 3, the outlets 34A, 34B of the exit portions 32A, 32B of the branches 28A, 28B, which, in this embodiment, define outlets of the cooling passages 20, are arranged at the second surface 16 of the substrate 12 closer together than the inlets 22 of the cooling passages 20, i.e., since there are two outlets 34A, 34B for each inlet 22. This configuration advantageously allows the cooling fluid $C_F$ to be delivered to more surface area of the second surface 16, thus increasing film cooling provided to the second surface 16 by the cooling fluid $C_F$ during operation, and also reducing the amount of cooling fluid $C_F$ that is required to cool the second surface 16, thereby increasing efficiency of the engine. Moreover, the cooling fluid $C_F$ passing through the branched cooling passages 20 provides convective cooling for the substrate 12 before exiting the cooling passages 20 to provide film cooling for the second surface 16 of the substrate 12.

Figure 4:
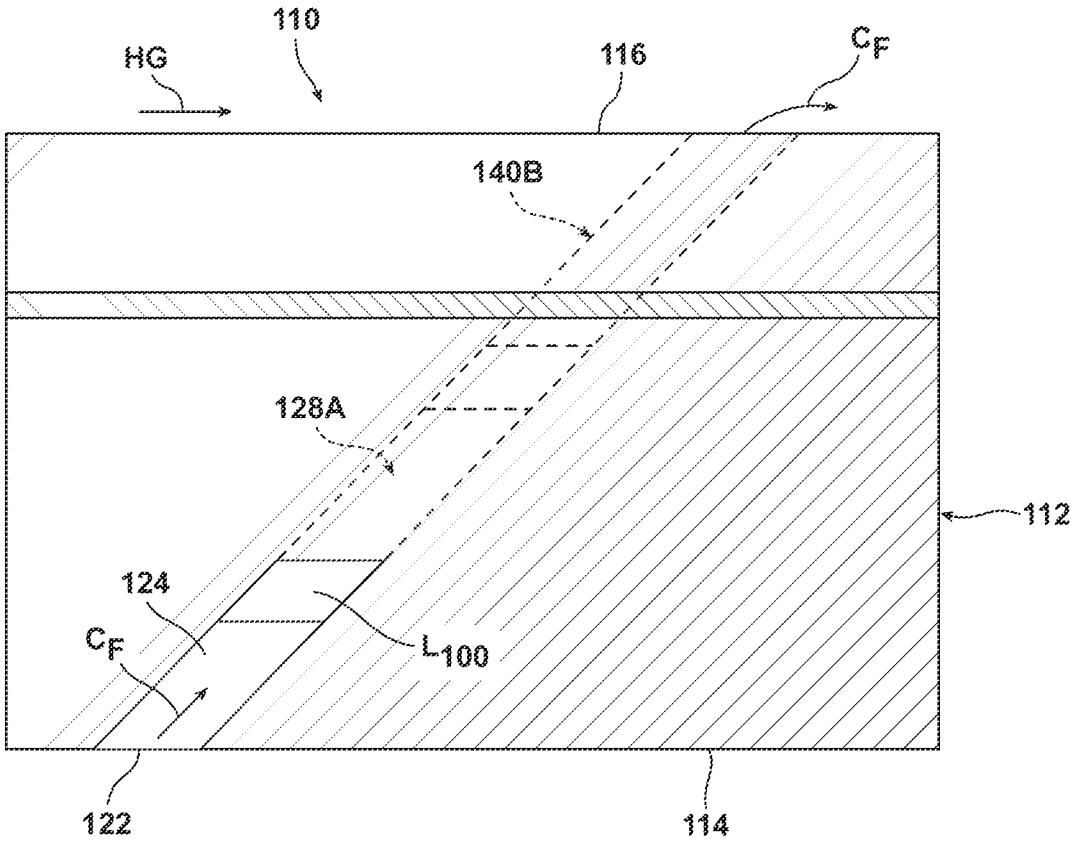
FIG. 4 is a side cross sectional view of a film cooled component wall according to another embodiment of the invention.
Figure 5:
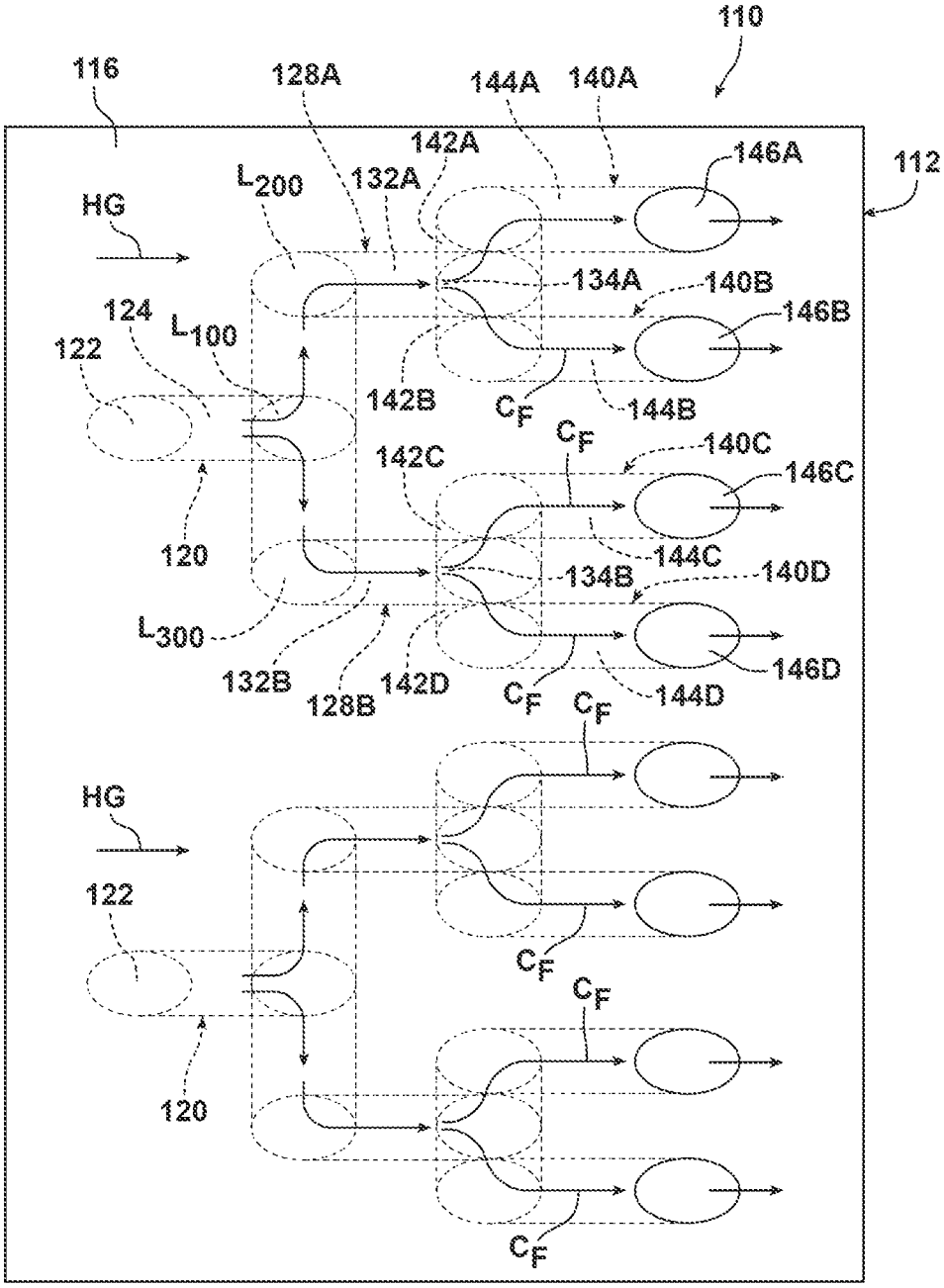
FIG. 5 is a plan cross sectional view of the film cooled component wall shown in FIG. 4.

Referring now to FIGS. 4 and 5, a component wall 110 having a plurality of cooling passages 120 formed in a substrate 112 according to another embodiment of the present invention is shown. In FIGS. 4 and 5, structure similar to that described above with reference to FIGS. 1-3 includes the same reference number increased by 100. Further, only the structure that is different from that described above with reference to FIGS. 1-3 will be specifically described for FIGS. 4 and 5.

A single one of the cooling passages 120 will now be described, it being understood that the remaining cooling passages 120 of the component wall 110 may be substantially identical to the described cooling passage 120.

As shown in FIG. 5, first and second branches 128A, 128B of the cooling passage 120 are divided at respective outlets 134A, 134B thereof into first, second, third, and fourth secondary branches 140A, 140B, 140C, 140D. The first and second branches 128A, 128B are divided into the secondary branches 140A-D between a first location $L_{100}$ where the first and second branches 128A, 128B are branched off from an entrance passage 124 of the cooling passage 120 and a second surface 116 of the substrate 112. As shown in FIG. 4, the first location $L_{100}$ according to this embodiment is closer to a first surface 114 of the substrate 112 than to the second surface 116 of the substrate 112. Further, the first and second branches 128A, 128B are divided into the secondary branches 140A-D closer to the second surface 116 of the substrate 112 than to the first surface 114 of the substrate 112.

Referring to FIG. 5, the first, second, third, and fourth secondary branches 140A-D each comprise a secondary intermediate portion 142A-D that extends transversely from an exit portion 132A, 132B of the respective branch 128A, 128B, e.g., about 90 degrees relative to the respective exit portion 132A, 132B in the embodiment shown; and a secondary exit portion 144A-D that extends transversely from its respective secondary intermediate portion 142A-D, about 90 degrees relative to the respective secondary intermediate portion 142A-D in the embodiment shown. The secondary intermediate portions 142A-D receive cooling fluid $C_F$ from a respective branch 128A, 128B and deliver the cooling fluid $C_F$ to the respective secondary exit portions 144A-D. The secondary exit portions 144A-D then deliver the cooling fluid $C_F$ out of the cooling passage 120 through outlets 146A-D of the respective secondary exit portions 144A-D to the second surface 116 of the substrate 112. In this embodiment, since the cooling passage 120 comprises four secondary branches 140A-D, the cooling passage 120 comprises one inlet 122 and four outlets 146A-D.

As shown in FIG. 5, the outlets 146A-D of the exit portions 144A-D of the secondary branches 140A-D, which, in this embodiment, define outlets of the cooling passages 120, are arranged at the second surface 116 of the substrate 112 closer together than the inlets 122 of the cooling passages 120, i.e., since there are four outlets 146A-D for each inlet 122. This configuration allows the cooling fluid $C_F$ to be delivered to even more surface area of the second surface 116, thus further increasing film cooling provided to the second surface 116 by the cooling fluid $C_F$ during operation, and also even further reducing the amount of cooling fluid $C_F$ that is required to cool the second surface 116, thereby increasing efficiency of the engine.

The cooling passages 20, 120 described herein may include additional branches than the ones shown depending on the total thickness $T_T$ of the substrates 12, 112.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component wall in a turbine engine comprising:

a substrate having a first surface and a second surface opposed from the first surface, the substrate having a thickness defined between the first and second surfaces; and at least one cooling passage extending through the substrate for delivering cooling fluid from a chamber associated with the first surface to the second surface, the at least one cooling passage being divided at a first location downstream from an inlet of the at least one cooling passage, the inlet located at the first surface of the substrate and the first location located about midway between the first and second surfaces of the substrate, the at least one cooling passage comprising:

a common entrance portion for receiving the cooling fluid from the inlet, the common entrance portion extending from the inlet to the first location;

first and second branches that receive the cooling fluid from the common entrance portion at the first location, the first and second branches each comprising:

an intermediate portion that extends transversely from the common entrance portion and receives cooling fluid from the entrance portion; and an exit portion that extends transversely from the respective intermediate portion, the exit portion receiving the cooling fluid from the respective intermediate portion and delivering the cooling fluid out of the respective branch through an outlet of the respective exit portion;

wherein the cooling fluid is delivered out of the at least one cooling passage to provide cooling to the second surface of the substrate, and wherein the intermediate portions of the first and second branches are positioned on opposite sides of the common entrance portion from about 60 degrees to about 90 degrees relative to the common entrance portion.

2. The component wall of claim 1, wherein the at least one cooling passage extends through the substrate at an angle of from about 15 degrees to about 60 degrees relative to the second surface of the substrate.

3. The component wall of claim 1, wherein the exit portions of the first and second branches are positioned from about 60 degrees to about 90 degrees relative to the respective intermediate portions.

4. The component wall of claim 3, wherein the exit portions of the first and second branches are generally parallel to the common entrance portion.

5. The component wall of claim 1, wherein the outlets of the exit portions of the first and second branches define outlets of the at least one cooling passage such that the at least one cooling passage comprises one inlet and two outlets, the exit portions delivering the cooling fluid from the outlets directly to the second surface of the substrate.

6. The component wall of claim 1, wherein the first and second branches are divided between the first location and the second surface of the substrate such that the at least one cooling passage further comprises first, second, third, and fourth secondary branches, the first and second secondary branches extending from the outlet of the exit portion of the first branch and the third and fourth secondary branches extending from the outlet of the exit portion of the second branch.

7. The component wall of claim 6, wherein the first location is closer to the first surface of the substrate than to the second surface of the substrate and the first and second branches are divided closer to the second surface of the substrate than to the first surface of the substrate.

8. The component wall of claim 6, wherein the first, second, third, and fourth secondary branches each comprise:

a secondary intermediate portion that extends transversely from the exit portion of the respective branch and receives cooling fluid from the respective branch; and a secondary exit portion that extends transversely from the respective secondary intermediate portion, the secondary exit portion receiving the cooling fluid from the respective secondary intermediate portion and delivering the cooling fluid out of the at least one cooling passage through an outlet of the respective secondary exit portion to the second surface of the substrate such that the at least one cooling passage comprises one inlet and four outlets.

9. The component wall of claim 1, wherein the first and second branches are completely enclosed within the substrate between the common entrance portion and the outlets of the first and second exit portions.

10. The component wall of claim 9, wherein the at least one cooling passage is cast in the substrate.

11. A component wall in a turbine engine comprising:

a substrate having a first surface and a second surface opposed from the first surface, the substrate having a thickness defined between the first and second surfaces; and at least one cooling passage extending through the substrate for delivering cooling fluid from a chamber associated with the first surface to the second surface, the at least one cooling passage comprising:

a common entrance portion extending from an inlet of the at least one cooling passage to a first location spaced from the inlet in a first direction that is perpendicular to the second surface of the substrate, the first location located about midway between the first and second surfaces of the substrate;

a first intermediate portion extending from the first location at an angle of about 60 degrees to about 90 degrees relative to the common entrance portion to a second location spaced from the first location in a second direction that is parallel to the second surface of the substrate; and a first exit portion extending transversely from the first intermediate portion from the second location to a first outlet spaced from the second location in the first direction.

12. The component wall of claim 11, wherein the first exit portion is positioned from about 60 degrees to about 90 degrees relative to the first intermediate portion.

13. The component wall of claim 12, wherein the first exit portion is generally parallel to the common entrance portion.

14. The component wall of claim 11, wherein the at least one cooling passage is divided at the first location and further comprises:

a second intermediate portion extending at an angle of about 60 degrees to about 90 degrees relative to the common entrance portion from the first location to a third location spaced from the first location in the second direction and being on the opposite side of the common entrance portion than the second location; and a second exit portion extending transversely from the second intermediate portion from the third location to a second outlet spaced from the third location in the first direction.

15. The component wall of claim 14, wherein:

the first intermediate portion extends from the first location to the second location at an angle of about 90 degrees relative to the common entrance portion; and the second intermediate portion extends from the first location to the third location at an angle of about 90 degrees relative to the common entrance portion.

16. The component wall of claim 11, wherein the first intermediate portion and the first exit portion are completely enclosed within the substrate between the common entrance portion and the outlet of the first exit portion.

17. The component wall of claim 11, wherein the at least one cooling passage is cast in the substrate.

* * * * *